US009945014B2

(12) United States Patent
Lee et al.

(10) Patent No.: US 9,945,014 B2
(45) Date of Patent: Apr. 17, 2018

(54) HIGH-MANGANESE WEAR RESISTANT STEEL HAVING EXCELLENT WELDABILITY AND METHOD FOR MANUFACTURING SAME

(71) Applicant: POSCO, Pohang-si (KR)

(72) Inventors: Soon-Gi Lee, Pohang-si (KR); In-Shik Suh, Pohang-si (KR); In-Gyu Park, Pohang-si (KR); Hong-Ju Lee, Pohang-si (KR)

(73) Assignee: POSCO, Pohang-si (KR)

( * ) Notice: Subject to any disclaimer, the term of this patent is extended or adjusted under 35 U.S.C. 154(b) by 365 days.

(21) Appl. No.: 14/654,639

(22) PCT Filed: Dec. 28, 2012

(86) PCT No.: PCT/KR2012/011745
§ 371 (c)(1),
(2) Date: Jun. 22, 2015

(87) PCT Pub. No.: WO2014/104441
PCT Pub. Date: Jul. 3, 2014

(65) Prior Publication Data

US 2015/0322551 A1 Nov. 12, 2015

(30) Foreign Application Priority Data

Dec. 27, 2012 (KR) ..... 10-2012-0155559

(51) Int. Cl.
*C21D 8/00* (2006.01)
*C22C 38/04* (2006.01)
(Continued)

(52) U.S. Cl.
CPC ..... *C22C 38/12* (2013.01); *C21D 6/005* (2013.01); *C21D 6/008* (2013.01); *C21D 8/005* (2013.01);
(Continued)

(58) Field of Classification Search
CPC ..... C22C 38/12; C22C 38/002; C22C 38/02; C22C 38/14; C22C 38/04; C21D 8/005; C21D 6/008; C21D 6/005
See application file for complete search history.

(56) References Cited

U.S. PATENT DOCUMENTS 4,047,979 A * 9/1977 Grange ..... C21D 8/0205 148/335
2006/0162824 A1* 7/2006 Merwin ..... C21D 8/0205 148/653
(Continued)

FOREIGN PATENT DOCUMENTS

CN 101248203 8/2008
CN 101346480 1/2009
(Continued)

OTHER PUBLICATIONS

Machine translation of JP2007-154295A (no date available).*
(Continued)

*Primary Examiner* — Kiley Stoner
(74) *Attorney, Agent, or Firm* — Cantor Colburn LLP

(57) ABSTRACT

A high-manganese wear-resistant steel having excellent weldability comprises 5 to 15 wt % of Mn, 16≤33.5C+Mn≤30 of C, 0.05 to 1.0 wt % of Si, and a balance of Fe and other inevitable impurities. The microstructure thereof includes martensite as a major component, and 5% to 40% of residual austenite by area fraction.

14 Claims, 3 Drawing Sheets

(51) Int. Cl.

| | |
|---|---|
| ***C22C 38/12*** | (2006.01) |
| ***C21D 6/00*** | (2006.01) |
| ***C22C 38/02*** | (2006.01) |
| ***C22C 38/00*** | (2006.01) |
| ***C22C 38/14*** | (2006.01) |

(52) U.S. Cl.
CPC ..... *C22C 38/002* (2013.01); *C22C 38/02* (2013.01); *C22C 38/04* (2013.01); *C22C 38/14* (2013.01)

(56) References Cited

U.S. PATENT DOCUMENTS

| | | | | |
|---|---|---|---|---|
| 2008/0240969 | A1 | 10/2008 | Kim et al. | |
| 2009/0074605 | A1 | 3/2009 | Posco | |
| 2009/0202382 | A1 | 8/2009 | Posco | |
| 2011/0198002 | A1 | 8/2011 | Tatsuya et al. | |
| 2011/0290384 | A1* | 12/2011 | Otsuki | C21D 5/00 148/614 |
| 2012/0045358 | A1* | 2/2012 | Lee | C21D 6/005 420/74 |
| 2012/0279616 | A1 | 11/2012 | Miyanishi et al. | |
| 2013/0092295 | A1* | 4/2013 | Yokoi | C21D 8/0226 148/504 |
| 2013/0174949 | A1* | 7/2013 | Hatano | C21D 6/004 148/609 |

FOREIGN PATENT DOCUMENTS

| | | | | | |
|---|---|---|---|---|---|
| CN | 102741440 | | 10/2012 | | |
| EP | 2520684 | | 11/2012 | | |
| JP | 51096721 | | 8/1976 | | |
| JP | 11061339 | | 3/1999 | | |
| JP | 2001140039 | | 5/2001 | | |
| JP | 2003138345 | | 5/2003 | | |
| JP | 3857939 | | 12/2006 | | |
| JP | 2007154295 | | 6/2007 | | |
| JP | 2010126770 | | 6/2010 | | |
| JP | 5315956 | | 10/2013 | | |
| KR | 20070023831 | A * | 3/2007 | | C21D 6/005 |
| KR | 20070067950 | A * | 6/2007 | | C21D 6/004 |
| KR | 1020070067950 | | 6/2007 | | |
| KR | 1020080060982 | | 7/2008 | | |
| KR | 1020110075611 | | 7/2011 | | |
| KR | 1020120071583 | | 7/2012 | | |
| KR | 1020120071585 | | 7/2012 | | |
| WO | WO 2007052773 | A1 * | 5/2007 | | C22C 38/001 |
| WO | 2012092122 | | 7/2012 | | |

OTHER PUBLICATIONS

Chinese Office Action—Chinese Application No. 201280077997X dated Apr. 19, 2016, citing JP2007154295, CN101346480, CN102741440, CN101248203, JP3857939 and JP5315956.

International Search Report—PCT/KR2012/011745 dated Jul. 3, 2013.

European Search Report—European Application No. 12891083.3 dated Dec. 1, 2015, citing JP 2007154295, U.S. Pat. No. 2011/198002, U.S. Pat. No. 2008/240969 and EP 2 520 684.

* cited by examiner

HIGH-MANGANESE WEAR RESISTANT STEEL HAVING EXCELLENT WELDABILITY AND METHOD FOR MANUFACTURING SAME

TECHNICAL FIELD

The present disclosure relates to a high-manganese wear-resistant steel having excellent weldability and a method for manufacturing the same.

BACKGROUND ART

The present invention relates to a steel which can be applied to heavy construction equipment, dump trucks, mining machinery, conveyors and the like, and more specifically, to high-manganese wear-resistant steel having excellent weldability.

DISCLOSURE

Technical Problem

Recently, wear-resistant steel is being used for equipment or for parts that are required to have wear resistant properties in various industrial fields such as heavy construction equipment, dump trucks, mining machinery, conveyors and the like. Wear-resistant steel is largely classified into austenitic work-hardened steel and martensitic high-hardened steel.

Hadfield steel, having about 12 wt % of manganese (Mn) and about 1.2 wt % of carbon (C), in which the microstructure thereof has austenite, is a typical example of the austenitic work-hardened steel, and is being used in various fields, such as the mining industry, the trucking industry, and the defense industry. However, Hadfield steel has a very low initial yield strength of about 400 MPa, and thus, the application thereof is limited to be used as a general wear-resistant steel or structural steel, each of which requires high hardness.

In comparison, the martensitic high-hardened steel has high yield strength and tensile strength, and thus, is widely used as a structural material, in the transportation/construction machinery, and the like. In general, for high-hardened steel, the high alloy addition amounts and quenching processes are essential for obtaining a martensitic structure in order to obtain sufficient hardness and strength. As a typical martensitic wear-resistant steel, the HARDOX series manufactured by SSAB has excellent hardness and strength. For such wear-resistant steels, the demand for forming wear-resistant steel as a thick plate is rapidly increasing with the trend for the enlargement of industrial machinery and the expansion of fields in which such machinery is used.

Meanwhile, for wear-resistant steel, there are many cases that require high degrees of resistance to abrasive wear according to the usage environment thereof. In order to secure resistance to abrasive wear, hardness is a very important factor. In order to secure hardness, many alloy elements are added to improve hardenability of a material or accelerated cooling is performed to secure a hard phase. In the case of a thin plate, the thickness center of a structure having a high degree of hardness may be obtained by adding alloy elements and performing accelerated cooling, but in the case of a thick plate, it is difficult to obtain a cooling rate sufficient for obtaining the hard phase to the center of the material, and thus, there is a basic method in that a high hardness value is obtained at a relatively low cooling rate by securing hardenability through increasing the number of alloy elements.

However, in order to secure hardness in the center of a thick plate, when many alloy elements are added cracks may be easily generated in a weld heat-affected zone at the time of welding, and in particular, in order to suppress cracks generated at the time of welding a thick plate, materials should be preheated to a high temperature, and thus, weldability is deteriorated, and eventually, welding costs are increased. Therefore, the use thereof is limited. Accordingly, this problem is recognized as an obstacle to thick plates of wear-resistant steel having excellent weldability. In addition, Cr, Ni, Mo, and the like that are added for increasing hardenability are relatively expensive elements, and thus, manufacturing costs may be high.

Technical Solution

An aspect of the present disclosure is to provide wear-resistant steel having excellent welding zone properties, in which the addition of high-priced alloy elements that increase manufacturing costs is decreased and high hardness in the center in a thickness direction is secured, and a method for manufacturing the same.

The present invention provides high-manganese wear-resistant steel having excellent weldability, in which the steel includes 5 to 15 wt % of Mn, $16 \leq 33.5C+Mn \leq 30$ of C, 0.05 to 1.0 wt % of Si, and a balance of Fe and other inevitable impurities, and the microstructure thereof includes martensite as a major component, and 5% to 40% of residual austenite by area fraction.

In addition, the present invention provides a method of manufacturing high-manganese wear-resistant steel having excellent weldability, in which the method includes:

heating a steel slab including 5 to 15 wt % of Mn, $16 \leq 33.5C+Mn \leq 30$ of C, 0.05 to 1.0 wt % of Si, and a balance of Fe and other inevitable impurities at the temperature range of 900° C. to 1100° C. for 0.8 t (t: slab thickness, mm) minutes or fewer;

hot rolling the heated slab to manufacture a steel sheet; and cooling the steel sheet martensite transformation initiation temperature (MS) or above at a cooling rate of 0.1° C./s to 20° C./s.

Advantageous Effects

According to the present invention, it is possible to provide thick wear-resistant steel having excellent wear resistance and weldability. The present invention has an advantage in that martensite is easily formed by controlling the contents of manganese, and carbon and residual austenite are properly formed in a segregation zone, thereby improving both wear resistance and weldability.

BEST MODE

Figure 1:
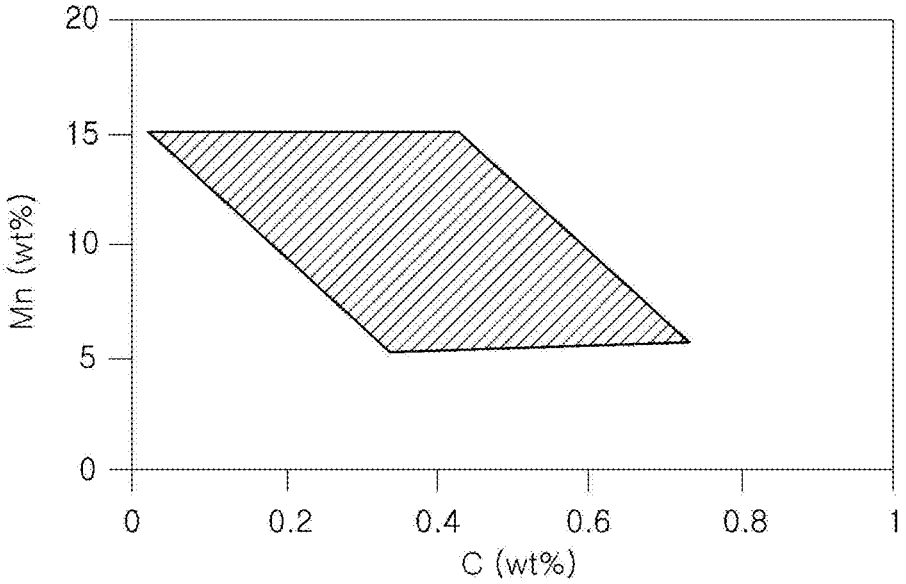
FIG. 1 is a graph illustrating the content ranges of manganese and carbon defined in the present invention.

The inventors of the present invention thoroughly looked into a solution for solving the conventional problems of wear-resistant steel. As a result, the inventors found that a segregation zone and a negative segregation zone are formed in a microstructure due to the segregation that is inevitably generated at the time of casting, mainly, the segregations of manganese and carbon, and thus, a phase transformation that is different occurs between the two zones, thereby causing the non-homogenization of the microstructure. It is recognized that segregation inside steel is the biggest cause of non-homogenization of the microstructure and the non-homogenization of the physical properties thereby. Therefore, an attempt was made to reduce segregation by inducing the diffusion of alloy elements through a homogenization treatment, and the like.

The present inventors searched for a way to easily use the segregation, and they also recognized that conventional problems may be solved by forming a structure that is different from the matrix structure in the segregation zone by precisely controlling the contents of manganese and carbon. In other words, the present inventors confirmed that the contents of manganese and carbon that are main alloy elements are precisely controlled to form martensite as a main structure in the negative segregation zone and austenite is maintained at room temperature due to the concentration of alloy elements in the segregation zone to form soft phase austenite, and thereby, it is possible to manufacture high-manganese wear-resistant steel that is economical, because the ultra-thickening and welding cracks generated at the conventional limits of wear-resistant steel are not generated. As a result, the present inventors completed the present invention.

In general, high-manganese steel relates to steel having 2.6 wt % or more of manganese. There are advantages in that the combination of many physical properties may be formed using the micro-structural properties of high-manganese steel, and the technical problems of high-carbon and high-alloy martensitic wear-resistant steel may be solved.

The present invention relates to thick high-manganese wear-resistant steel having improved levels of performance, such as wear resistance and weldability by having martensite as a main structure through controlling the components and including residual austenite due to the concentration of alloy components in the segregation zone. When the content of manganese in high-manganese steel is 2.6 wt % or more, the bainite or ferrite production curve is dramatically moved backward, and thus, martensite is stably formed at a low cooling rate as compared with conventional high-carbon wear-resistant steel after hot rolling or a solution treatment. In addition, when the content of manganese is high, there is an advantage in that high hardness may be obtained even with relatively low carbon content as compared with general high-carbon martensitic steel.

When wear-resistant steel is manufactured using the phase transformation properties of high-manganese steel, it is possible to obtain a small deviation in hardness distribution from the surface layer to the internal area. Steel is commonly quenched through water cooling and the like so as to obtain martensite. At this time, the cooling rate is gradually decreased as it is moved from the surface layer to the center zone. Therefore, because the steel is thick, the hardness of the center zone is significantly low. In the case of manufacturing with the components of conventional wear-resistant steel, when the cooling rate is low, many phases, such as bainite and ferrite having low hardness, are formed in the microstructure. However, in the case in which the content of manganese is high, as in the present invention, even if the cooling rate is low, it is sufficiently possible to obtain martensite, and thus, there is an advantage in that high hardness may be maintained to the center zone of thick steel.

However, when thick steel is manufactured using such a method, a large amount of manganese is added in order to secure the hardenability of the center zone, and thus, martensite transformation at a welding heat-affected zone due to high hardenability and residual stress thereby may be generated. Therefore, welding cracks may be generated, and thus, the thickening of the wear-resistant steel through the increase of alloy elements reaches a limit. The present invention was able to solve the above-described problems by forming a soft austenite capable of alleviating residual stress due to martensite transformation in the welding heat-affected zone by precisely controlling the contents of manganese and carbon. This fact will be described in more detail with reference to the following Examples.

Hereinafter, the present invention will be described in detail.

The wear-resistant steel, according to the present invention, includes 5 to 15 wt % of Mn, $16 \leq 33.5C+Mn \leq 30$ of C, 0.005 to 1.0 wt % of Si, and a balance of Fe and other inevitable impurities, and the microstructure thereof includes martensite as a major component in addition to 40% or less residual austenite.

Firstly, the composition range of the present invention will be described in detail. The content of the component element is indicated as wt %.

Manganese (Mn): 5% to 15%

Manganese (Mn) is one of the most important elements to be added in the present invention. Within a proper range, manganese may stabilize austenite. It is preferable to include 5% or more of manganese in order to stabilize martensite in the following range of carbon content. When the manganese is included in an amount less than 5%, the stabilization of austenite by manganese is insufficient, and thus, it is difficult to obtain residual austenite in a segregation zone. In addition, when the content thereof is excessively included to exceed 15%, the residual austenite is excessively stabilized, and thus, the fraction of residual austenite to be desired is excessively generated and the fraction of martensite is decreased. Therefore, it is difficult to obtain the hard structure of the fraction that is sufficient for securing wear resistance. As such, in the present invention, the content of manganese is 5% to 15%, and thus, the austenite structure that is stable in the cooling after the hot rolling or solution treatment may be easily secured.

Carbon (C): $16 \leq 33.5C+Mn \leq 30$

Carbon is an important element for securing martensite fraction and hardness by increasing the hardenability of a steel along with manganese. In particular, carbon has a significant effect of securing residual austenite stability and fraction by being segregated along with manganese in a segregation zone. Therefore, in the present invention, the component range that optimizes the effect thereof may be limited.

The range of carbon for sufficiently securing the fraction of residual austenite that is required in the present invention is determined by the combination with manganese having the same effect. For this reason, it is preferable that the carbon is added in an amount such that 33.5C+Mn, a carbon content equation, is to be 16 or more. When the carbon content equation is less than 16, the austenite stability is lacking, and thus, the desired residual austenite fraction is not satisfied. When the carbon content equation exceeds 30, the austenite is excessively stabilized, and thus, it is difficult to obtain the desired residual austenite fraction. Therefore, preferably, the value of 33.5C+Mn has a range of 16 to 30. Meanwhile, the ranges of the Mn and C that are defined in the present invention are illustrated in FIG. 1.

Silicon (Si): 0.05% to 1.0%

Silicon is a deoxidizer, and is an element for improving strength according to solid-solution strengthening. To this end, the content thereof is 0.05% or more. When the content thereof is high, the toughness of the welding zone and base metal are decreased, and thus, it is preferable to limit the upper limit of the content of the silicon to 1.0%.

In addition to the components, the wear-resistant steel of the present invention further includes one or more of niobium (Nb), vanadium (V), titanium (Ti), and boron (B), thereby further improving the effectiveness of the present invention.

Nb: 0.1% or less

Niobium is included to increase strength through precipitation hardening and is an element for improving impact toughness by refining crystal grains at the time of low temperature rolling. However, when the content thereof exceeds 0.1%, a coarse precipitate is produced, thereby deteriorating hardness and impact toughness. Therefore, preferably, the amount of niobium is limited to 0.1% or less.

V: 0.1% or less

Vanadium has an effect on easily forming martensite by delaying the ferrite and bainite phase transformation rate by being solid-solutionized in steel, and also, is included to increase strength through a solid-solution strengthening effect. However, when the content thereof exceeds 0.1%, the solid-solution strengthening effect is satisfied, thereby deteriorating toughness and weldability and significantly increasing the manufacturing cost. Therefore, it is preferable to limit the content thereof to 0.1% or less.

Ti: 0.1% or less

Titanium is an element for maximizing the effect of B, which is an important element for improving hardening. In other words, titanium suppresses the BN formation through a TiN formation, and thus, increases the content of solid-solution B, thereby improving hardening. The precipitated TiN is allowed to pin the crystal grains of austenite, and thus, has an effect of suppressing the coarsening of the crystal grains. However, when titanium is excessively added, problems, such as a decrease in toughness, may be generated, due to coarsening of the titanium precipitate. Therefore, it is preferable that the content thereof is 0.1% or less.

B: 0.02% or less

Boron is an element that is included to effectively increase the hardening of steel even when added in small amounts. Boron has an effect of suppressing the grain boundary breaking through a crystal grain boundary strengthening, but when it is excessively added, the toughness and weldability are decreased by the formation of coarse precipitate. Therefore, it is preferable to limit the content thereof to 0.02% or less.

For wear resistance according to the present invention, the balance component is iron (Fe). However, in the general steel manufacturing process, unintended impurities may inevitably be mixed in from the raw materials or surrounding environment, and also, the impurities is not excluded. These impurities are known by people skilled in the general steel manufacturing process, and thus, all the contents thereof will not be provided in the present specification.

Preferably, the wear-resistant steel of the present invention includes 60% or more of martensite as a major structure by area fraction. When the fraction of martensite is less than 60%, it is difficult to secure the hardness to a level thereof intended in the present invention.

Furthermore, it is preferable to be 5% to 40% of the residual austenite by area fraction. When the fraction of the residual austenite is less than 5%, it is difficult to absorb strain at the time of welding, and thus, it is difficult to secure weldability. Meanwhile, when the fraction of the residual austenite exceeds 40%, the fraction of soft austenite is excessively increased, and thus, it is difficult to secure the hardness that is required for wear resistance. As the remainder, inevitable phases generated in the manufacturing process may be included. As in other structures, there may be α'-martensite, ε-martensite, carbide, and the like.

The microstructure of the present invention will be described in more detail. As described below, the present invention uses the segregation zone formed in the steel slab. In other words, the segregation zone formed in the steel slab is maintained during being subjected to the rolling and cooling processes, and the formation of the residual austenite is induced in the segregation zone. The part formed with the segregation zone may indicate the segregation zone in the wear-resistant steel of the present invention.

The wear-resistant steel of the present invention includes a martensitic structure as a major component, and 40% to 50% of the segregation zone by area fraction. The residual austenite is preferably formed in the segregation zone. At this time, residual austenite may be formed all over the segregation zone, or may be formed in a smaller range in the total area thereof. Therefore, the residual austenite is preferably 5% to 40% by steel area fraction.

Therefore, for the wear-resistant steel of the present invention, the matrix structure thereof is composed of a martensitic structure, and includes the residual austenite formed in the area of the segregation zone, and other structures may be formed in the part without the residual austenite. At this time, the residual austenite is preferably 70% to 100% by area fraction, and other structures may be formed in the remaining area.

Meanwhile, preferably, the area of the segregation zone having the residual austenite structure has a size of 100 to 10000 μm in the rolling direction (x axis) in the x-z cross section and 5 to 30 μm in the thickness direction (z axis), which are the cross sections of the rolling direction and the thickness direction, when, for the wear-resistant steel, the rolling direction is defined as the x axis, the width direction is defined as the y axis, and the thickness direction is defined as the z axis. The segregation zone area is the region with the residual austenite, is different from the segregation zone formed in the steel slab, and indicates the part of the segregation zone in the steel after being rolled. The segregation zone is formed to be elongated in the rolling direction and the horizontal direction and formed to be relatively short in the vertical direction of the rolling direction (the thickness direction of a steel sheet) as the rolling is performed.

Meanwhile, the average packet size of the martensite is preferably 20 μm or less. When the packet size is less than μm, the martensitic structure is refined, and thus, impact toughness may be further improved. It is useful because the packet size is small, and thus, the lower limit thereof is not particularly limited. However, to date, due to technical limits, the packet size exhibits at least 3 μm or more. When the hot rolling and cooling processes are applied, the packet size is reduced, as a finishing rolling temperature is low, and when a hot rolled steel sheet is manufactured by applying the re-heating and cooling processes, the packet size is reduced, as the re-heating temperature is low. It is preferable that the finishing rolling temperature and the re-heating temperature are maintained to be 900° C. or below and 950° C. or below, respectively, so as to make the packet size to be 20 μm or less in the component range of the present invention.

When the manufacturing methods of the hot rolling and cooling or re-heating and cooling are applied using a steel having the component range according to the present invention, it is possible to secure martensite even in the center of a thick plate having a low cooling rate due to high hardenability. In addition, it is possible to manufacture an ultra-thick wear-resistant steel without producing welding cracks, and having 360 or more of the value of Brinell hardness even in the center because it is possible to obtain the strain absorption of the cracks of the welding zone and welding heat-affected zone by the residual stress due to the residual austenite present when the martensite transformation is generated due to high hardenability. The center is defined as an area at a position about ½ of the way through in the plate in a thickness direction thereof.

Hereinafter, the manufacturing method of the present invention will be described in detail.

The method according to the present invention includes heating a steel slab that satisfies the following composition at the temperature range of 900° C. to 1100° C. for a time of 0.8 t (t: slab thickness, mm) minutes or fewer;

hot rolling the heated slab; and cooling the hot-rolled slab at a Martensite transformation initiation temperature (MS) or above at a cooling rate of 0.1° C./s to 20° C./s.

The steel slab that satisfies the above-described composition is heated in the temperature range of 900° C. to 1100° C. For the steel slab, the segregation zone of alloy elements is generated during the manufacturing process (casting process, and the like), and when the temperature exceeds 1100° C., the homogenization of the alloy elements segregated in the segregation zone occurs due to excessive heat. As described above, the segregation zone may be reduced in size, and thus, spaces capable of securing the residual austenite are lacking. Therefore, it is difficult to obtain the purpose of the present invention. Accordingly, the heating temperature is preferably 1100° C. or less. Meanwhile, the steel slab is heated at less than 900° C., the austenite formation is not sufficiently performed in the steel slab, and thus, it is difficult to secure the wear-resistant steel of the present invention through the following phase transformation.

Meanwhile, the heating time of the steel slab in the present invention is preferably 0.8 t (t: slab thickness, mm) minutes or fewer. When the heating time exceeds 0.8 t minutes, there is a problem in that the homogenization of the segregation in the slab is performed due to excessive heat. However, the minimum thereof is not particularly limited.

In other words, in the present invention, the segregation zone formed in the steel slab does not appear, and thus, is maintained by controlling the heating temperature and heating time of the steel slab.

The heated steel slab is subjected to a hot rolling to manufacture a steel sheet. For the hot rolling, the method thereof is not particularly limited, and general methods that are used in the related art are used.

The finishing rolling at the time of the hot rolling is preferably performed at 750° C. or above. The finishing rolling is not particularly limited in terms of the technical implementation of the present invention. However, when the finishing rolling temperature is too low, that is, less than 750° C., it is difficult to perform the rolling through a proper reduction, thereby deteriorating the rolling shape. Therefore, it is preferable to perform the finishing rolling at a temperature of 750° C. or above.

The segregation zone is maintained in the steel sheet rolled after being subjected to the rolling. At this time, the size of the segregation zone is, as described above, preferably 100 to 10000 μm in the rolling direction (x axis) and 5 to 30 μm in the thickness direction (z axis).

The hot-rolled steel sheet is cooled at the temperature of martensite transformation initiation temperature (MS) or above at the cooling rate of 0.1° C./s to 20° C./s. The cooling is preferably performed until the phase transformation is completed. Through the cooling, the martensitic structure may be formed as the major phase of the microstructure of the wear-resistant steel of the present invention. When the cooling rate is less than 0.1° C./s, auto-tempering is generated, and thus, the martensitic structure is not sufficiently formed. In particular, it is difficult to form a sufficient martensitic structure in the center, and thus, it is difficult to secure the hardness required in the present invention. Meanwhile, when the cooling rate exceeds 20° C./s, it is difficult to use the phase transformation of the residual austenite in the segregation zone, and as a result, the austenite fraction is lacking. Therefore, there is a problem in that it is difficult to prevent a decrease in weldability.

Through the cooling process, martensite is formed as the major phase of the microstructure of the wear-resistant steel of the present invention, and residual austenite is included in 5% to 40% by area fraction. The residual austenite is formed at the site of the segregation zone, and is derived from the segregation zone.

For the present invention, re-heating is further performed, and cooling may be included. Through the re-heating and cooling, it is possible to make the size of the martensite packet to be 20 μm or less, and at this time, the re-heating temperature is preferably 950° C. or below.

Hereinafter, Examples of the present invention will be described in detail. The following Examples are only for illustrating the present invention, and are not limited to the present invention.

EXAMPLE 1

The ingots that satisfied the compositions listed in the following Table 1 were manufactured in a vacuum induction melting furnace to obtain a slab having a thickness of 80 mm. The slab was heated at 1050° C. for 50 minutes, and was subjected to a rough-rolling and finished-rolling to manufacture the sheet metal having a thickness of 30 mm. Subsequently, it was subjected to an accelerated cooling or air cooling, and the temperature of the finishing rolling was partially adjusted according to the test uses.

TABLE 1

| Division | C | Mn | Si | Ni | Cr | Mo | Nb | V | Ti | B | 33.5C + Mn |
|---|---|---|---|---|---|---|---|---|---|---|---|
| Invented Steel 1 | 0.21 | 10.2 | 0.2 | — | — | — | — | — | — | — | 17 |
| Invented Steel 2 | 0.35 | 8.6 | 0.1 | — | — | — | — | — | — | — | 20 |

TABLE 1-continued

| Division | C | Mn | Si | Ni | Cr | Mo | Nb | V | Ti | B | 33.5C + Mn |
|---|---|---|---|---|---|---|---|---|---|---|---|
| Invented Steel 3 | 0.32 | 9.8 | 0.2 | — | — | — | — | — | — | — | 21 |
| Invented Steel 4 | 0.13 | 12.2 | 0.3 | — | — | — | — | — | — | — | 17 |
| Invented Steel 5 | 0.41 | 11.2 | 0.2 | — | — | — | — | — | — | — | 25 |
| Invented Steel 6 | 0.2 | 10.3 | 0.2 | — | — | — | 0.04 | — | — | — | 17 |
| Invented Steel 7 | 0.31 | 10.1 | 0.1 | — | — | — | 0.02 | 0.03 | 0.02 | 0.0017 | 20 |
| Comparative Steel 1 | 0.15 | 4.3 | — | — | — | — | — | — | — | — | 9 |
| Comparative Steel 2 | 0.11 | 6.5 | — | — | — | — | — | — | — | — | 10 |
| Comparative Steel 3 | 0.8 | 10 | — | — | — | — | — | — | — | — | 37 |
| Comparative Steel 4 | 0.05 | 17 | — | — | — | — | — | — | — | — | 19 |
| Comparative Steel 5 | 0.16 | 1.6 | 0.33 | 0.2 | 0.7 | 0.3 | 0.02 | — | 0.014 | 0.0015 | 7 |

Specimens that were appropriate for the test were prepared to estimate the microstructure, Brinell hardness, wear resistance, weldability, and the like of the sheet metal thus obtained. The microstructure was observed using an optical microscope and a scanning electron microscope (SEM), and the wear resistances were compared by testing with the method disclosed in ASTM G65 and measuring the loss by weight. The y-groove test was performed using the same welding material for evaluating weldability, and pre-heating was not performed. The y-groove welding was performed, and then whether or not cracks were in the welding zone was observed with a microscope.

As the method of preparing specimens, which were used in the present embodiment, in the case of Invented Steels, it was possible to obtain sufficient hardenability due to the high addition of alloy elements, and thus, air cooling was performed without any special cooling facilities. In the case of Comparative Steels, hot rolling was performed, and then the accelerated cooling was immediately performed to obtain martensite. However, in the case of Invented Steels, if necessary, the hot rolling might be performed, and then the accelerated cooling might be performed. In addition, after performing the re-heating using a special heat treatment facility, accelerated cooling or air cooling was performed in some cases to obtain martensite. The present invention may be applied for any one of the cooling methods after hot rolling.

In the following Table 2, the structure and Brinell hardness were measured in the center of the steel sheet. This was because when the desired structure and hardness in the center of the steel sheet were achieved, the whole of the thickness of the steel sheet was achieved.

TABLE 2

| Division | Microstructure Fraction (Center, Area Fraction) | Brinell Hardness (Center, HB) | ASTM G65 Wear Resistant Test Loss of Weight (g) | Whether or Not Y-groove Cracks are Generated |
|---|---|---|---|---|
| Invented Steel 1 | M(89) + A(7) + R(4) | 412 | 1.13 | No cracks |
| Invented Steel 2 | M(84) + A(13) + R(3) | 397 | 1.17 | No cracks |

TABLE 2-continued

| Division | Microstructure Fraction (Center, Area Fraction) | Brinell Hardness (Center, HB) | ASTM G65 Wear Resistant Test Loss of Weight (g) | Whether or Not Y-groove Cracks are Generated |
|---|---|---|---|---|
| Invented Steel 3 | M(85) + A(10) + R(3) | 386 | 1.09 | No cracks |
| Invented Steel 4 | M(89) + A(8) + R(3) | 372 | 1.21 | No cracks |
| Invented Steel 5 | M(73) + A(25) + R(2) | 365 | 0.85 | No cracks |
| Invented Steel 6 | M(89) + A(7) + R(4) | 416 | 0.98 | No cracks |
| Invented Steel 7 | M(86) + A(7) + R(7) | 402 | 0.92 | No cracks |
| Comparative Steel 1 | M(100) | 437 | 1.35 | Cracks |
| Comparative Steel 2 | M(100) | 450 | 1.15 | Cracks |
| Comparative Steel 3 | A(100) | 175 | 0.56 | No cracks |
| Comparative Steel 4 | A(40) + R(60) | 240 | 0.78 | No cracks |
| Comparative Steel 5 | M(60) + R(40) | 320 | 1.11 | Cracks |

In the above Table 2, M is defined as martensite, A is defined as the residual austenite, and R is defined as another phase.

Figure 2:
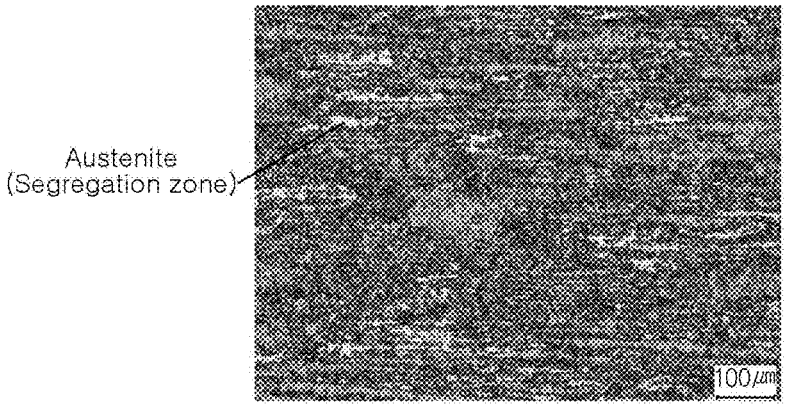
FIG. 2 is a photograph illustrating the microstructure of Invented Steel 1.

FIG. 2 is a photograph illustrating the microstructure of Invented Steel 1. Referring to FIG. 2, it can be confirmed that the residual austenite was included in the martensitic structure.

As listed in the above-described Table 2, it can be confirmed that for Invented Steels 1 to 7, the steel components achieved the component ranges of the present invention, and thus, it was possible to obtain 360 or more of the value of the value of Brinell hardness of the center according to the increase in hardenability. In addition, it can be confirmed that by satisfying the component ranges of the present invention, it was possible to obtain the desired fraction of austenite, and thus, even though the hardenability was high, there were no welding cracks. Among the inventive Steels, it can be confirmed that when niobium was added (Invented Steel 6), hardness was further increased, and in particular, in the case of Invented Steel 7 containing niobium, vanadium, titanium, and boron, the improvements of the hardness and wear resistance were excellent.

In the cases of Invented Steels manufactured by air cooling, they achieved 360 or more of the value of Brinell hardness, and it can be expected that the same results might be obtained at the center of a plate thicker than the Invented Steel.

Figure 3:
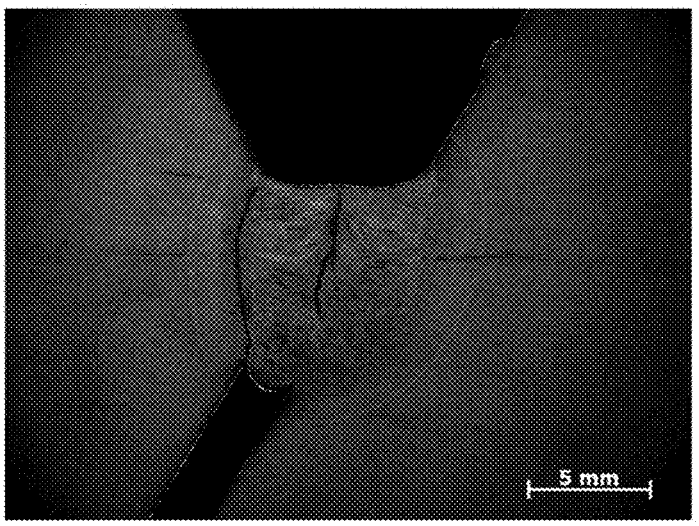
FIG. 3 is a photograph illustrating the result of the welding crack of Comparative Steel 2 by a y-groove test.
Figure 4:
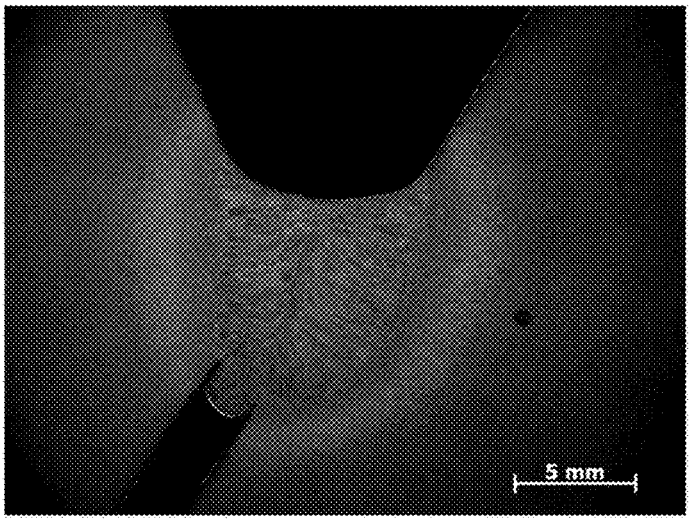
FIG. 4 is a photograph illustrating the result of the welding crack of Invented Steel 1 by a y-groove test.

In addition, according to the welding crack evaluation through a y-groove, it can be confirmed that for Invented Steels 1 and 2, welding cracks were generated due to high hardenability and martensite transformation by the welding. Comparative Steel 5 possessed the hardness of its center through adding an alloy element, but the generation of welding cracks was unavoidable due to the increase in hardenability. FIG. 3 illustrates the result of the welding crack of Comparative Steel 2 by a y-groove test, and FIG. 4 illustrates the result of the welding crack of Invented Steel 1 by a y-groove test. According to FIGS. 3 and 4, it can be confirmed that the Invented Examples according to the present invention exhibited excellent weldability.

EXAMPLE 2

In Table 1 of Example 1, steel sheets having a thickness of 70 mm and the compositions of Invented Steel 1 and Comparative Steel 5 were manufactured, respectively.

Figure 5:
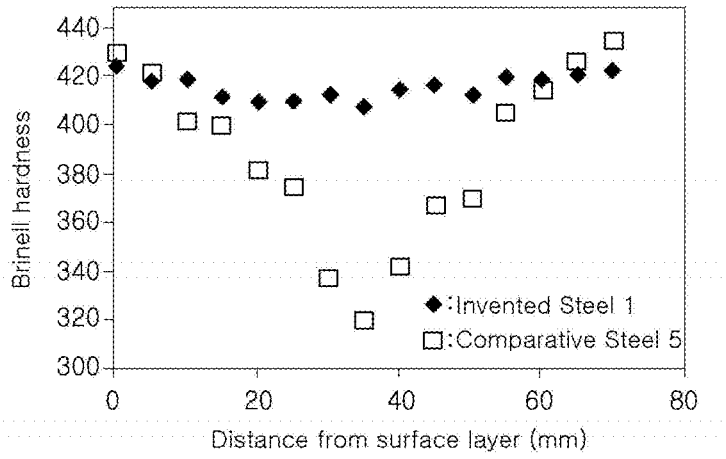
FIG. 5 is a graph illustrating the result of observing the change of Brinell hardness according to the thickness directions of Invented Steel 1 and Comparative Steel 5 in EXAMPLE 2.

The Brinell hardness distributions according to the thickness of the steel sheets were measured. The results thus obtained are illustrated in FIG. 5. From the results illustrated in FIG. 5, it can be confirmed that the wear-resistant steel according to the present invention had uniform hardness distribution in the thickness direction, but the Comparative Steel contained hardness in which the hardness at the center was significantly decreased. Therefore, it can be confirmed that for the wear-resistant steel of the present invention, hardness was not decreased as it was moved toward the center, and thus, there was a technical effect, in which the overall usage life span of the wear-resistant steel was not decreased.

The invention claimed is:

1. A high-manganese wear-resistant steel, the wear-resistant steel comprising 5 to 15 wt % of Mn, $16 \leq 33.5C+Mn \leq 30$ of C, 0.05 to 1.0 wt % of Si, and a balance of Fe and other inevitable impurities, wherein a microstructure of the wear-resistant steel includes martensite as a major component, 40% to 50% of segregation zones by area fraction, and residual austenite formed in the segregation zones, and wherein the segregation zones have a size of 100 to 10000 μm in a rolling direction of the wear-resistant steel and 5 to 30 μm in a thickness direction of the wear-resistant steel in a cross section formed by the rolling direction and the thickness direction.

2. The high-manganese wear-resistant steel of claim 1, wherein the wear-resistant steel further includes one or more selected from the group consisting of 0.1% or less of Nb, 0.1% or less of V, 0.1% or less of Ti, and 0.02% or less of B.

3. The high-manganese wear-resistant steel of claim 1, wherein an amount of the residual austenite is 5% to 40% by area fraction of the wear-resistant steel.

4. The high-manganese wear-resistant steel of claim 1, wherein an amount of the residual austenite is 70% to 100% by area fraction of the segregation zones.

5. The high-manganese wear-resistant steel of claim 1, wherein the microstructure includes one or more of α'-martensite, ç-martensite, and carbide.

6. The high-manganese wear-resistant steel of claim 1, wherein an amount of the martensite is 60% or more by area fraction of the wear-resistant steel.

7. The high-manganese wear-resistant steel of claim 1, wherein an average packet size of the martensite is 20 μm or less.

8. The high-manganese wear-resistant steel of claim 1, wherein a value of Brinell hardness is 360 or more in a center of the wear-resistant steel.

9. A method of manufacturing high-manganese wear-resistant steel, the method comprising:

heating a steel slab including 5 to 15 wt % of Mn, $16 \leq 33.5C+Mn \leq 30$ of C, 0.05 to 1.0 wt % of Si, and a balance of Fe and other inevitable impurities at a temperature range of 900° C. to 1100° C. for 0.8 t (t: slab thickness, mm) minutes or fewer;

hot rolling the heated steel slab to manufacture a steel sheet; and cooling the steel sheet at a cooling rate of 0.1 to 20° C./s from a martensite transformation initiation temperature (MS) or above.

10. The method of claim 9, wherein the heating is performed for a non-homogenization treatment of segregation zones of the steel slab.

11. The method of claim 9, wherein the steel slab further includes one or more selected from the group consisting of 0.1% or less of Nb, 0.1% or less of V, 0.1% or less of Ti, and 0.02% or less of B.

12. The method of claim 9, wherein, the rolling includes a finishing rolling at 750° C. or higher.

13. The method of claim 9, wherein the rolling is performed for a segregation zone of the steel sheet to have a size of 100 to 10000 μm in a rolling direction and 5 to 30 μm in a vertical direction to the rolling direction in a cross sections formed by the rolling direction and the vertical direction.

14. The method of claim 9, after the cooling, further comprising: re-heating at a temperature of 950° C. or below and then cooling.

* * * * *